US008936284B2

(12) United States Patent
Konchan

(10) Patent No.: US 8,936,284 B2
(45) Date of Patent: Jan. 20, 2015

(54) REMOTE MANUAL RELEASE FOR AN ELECTRIC LATCH MECHANISM OF A VEHICLE

(75) Inventor: Jeffrey L. Konchan, Romeo, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 204 days.

(21) Appl. No.: 13/616,967

(22) Filed: Sep. 14, 2012

(65) Prior Publication Data

US 2014/0075847 A1 Mar. 20, 2014

(51) Int. Cl.
*E05C 3/06* (2006.01)
*E05C 3/16* (2006.01)

(52) U.S. Cl.
USPC ..... 292/216; 292/201; 292/DIG. 65

(58) Field of Classification Search
USPC ..... 292/216, DIG. 23, DIG. 42, DIG. 65, 201
See application file for complete search history.

(56) References Cited

U.S. PATENT DOCUMENTS

| | | | | | |
|---|---|---|---|---|---|
| 2,563,317 | A | * | 8/1951 | Dix et al. | 292/171 |
| 2,612,397 | A | * | 9/1952 | Stutt | 292/166 |
| 3,858,922 | A | | 1/1975 | Yamanaka | |
| 4,525,004 | A | * | 6/1985 | Tanaka | 292/171 |
| 4,691,958 | A | * | 9/1987 | Miller | 296/146.1 |
| 4,917,418 | A | | 4/1990 | Gokee | |
| 4,945,784 | A | * | 8/1990 | Gergoe | 74/501.5 R |
| 4,974,885 | A | | 12/1990 | Yokoyama | |
| 4,998,758 | A | | 3/1991 | Kowalczyk et al. | |
| 5,222,774 | A | | 6/1993 | Fukumoto et al. | |
| 5,263,347 | A | * | 11/1993 | Allbaugh et al. | 70/257 |
| 5,386,713 | A | * | 2/1995 | Wilson | 70/280 |
| 5,531,086 | A | * | 7/1996 | Bryant | 70/279.1 |
| 5,535,608 | A | | 7/1996 | Brin | |
| 5,611,580 | A | * | 3/1997 | Choi | 292/164 |
| 5,636,536 | A | * | 6/1997 | Kinnucan | 70/107 |
| 5,660,081 | A | * | 8/1997 | Sato | 74/502 |
| 5,662,369 | A | | 9/1997 | Tsuge | |
| 5,715,712 | A | * | 2/1998 | West | 70/257 |
| 5,927,794 | A | | 7/1999 | Mobius et al. | |
| 6,017,067 | A | | 1/2000 | Yoneyama et al. | |
| 6,142,035 | A | * | 11/2000 | Babatz et al. | 74/501.6 |
| 6,854,870 | B2 | | 2/2005 | Huizenga | |
| 6,883,840 | B2 | | 4/2005 | Sueyoshi et al. | |
| 7,059,654 | B2 | * | 6/2006 | Ichinose | 296/146.1 |
| 7,780,207 | B2 | * | 8/2010 | Gotou et al. | 292/336.3 |
| 2006/0076788 | A1 | | 4/2006 | Gotou et al. | |
| 2008/0217955 | A1 | | 9/2008 | Charnesky et al. | |

FOREIGN PATENT DOCUMENTS

| | | | | |
|---|---|---|---|---|
| DE | 4033532 | A1 | | 4/1992 |
| DE | 4425423 | C1 | | 8/1995 |
| DE | 19809415 | A | | 9/1999 |
| DE | 102010053179 | | * | 6/2012 |

* cited by examiner

*Primary Examiner* — Carlos Lugo
(74) *Attorney, Agent, or Firm* — Quinn Law Group, PLLC

(57) ABSTRACT

A vehicle includes a release lever mounted within an interior cavity of a vehicle body. The release lever is manually rotatable between a disengaged position and an engaged position. When disposed in the disengaged position, the release lever is fully disposed within the interior cavity of the body. When disposed in the engaged position, the release lever traverses across a gap between the body and a door into engagement with a latch mechanism to move the latch mechanism into an unlocked position.

16 Claims, 3 Drawing Sheets

REMOTE MANUAL RELEASE FOR AN ELECTRIC LATCH MECHANISM OF A VEHICLE

TECHNICAL FIELD

The invention generally relates to a vehicle having an electric latch mechanism mounted internally within a side door of the vehicle, and a manual mechanical release therefor.

BACKGROUND

Some automotive vehicles include side doors that do not have outside door handles. For example, these vehicles may have an electronic touchpad mounted underneath the outer surface of the door for actuating an electric latch mechanism. For these types of doors, the electric latch mechanism releases the door and allows it to open in response to an electrical signal, rather than a traditional mechanical linkage connecting an outside door handle with the latch mechanism. Since there is no outside door handle, and electric power is required to release the latch mechanism, mechanically operated backups are used to actuate the latch mechanism should the electronic latch mechanism malfunction or vehicle electrical power is lost.

SUMMARY

A vehicle includes a body having a forward end and a rearward end. The forward end is spaced from the rearward end along a longitudinal axis. The body defines a door opening disposed on a side of the body, which is laterally offset from the longitudinal axis. A door is attached to the body and disposed within the door opening. The door is pivotably moveable between an open position and a closed position. When in the open position, the door allows access to an interior compartment of the body. When in the closed position, the door seals the door opening. The door and the body cooperate to define a gap therebetween that extends laterally relative to the longitudinal axis. A latch mechanism is internally mounted to the door within an interior cavity of the door. The latch mechanism is moveable in response to an electronic signal between an unlocked position and a locked position. When in the unlocked position, the latch mechanism allows movement of the door between the open position and the closed position. When in the locked position, the latch mechanism is operable to secure the door relative to the body in the closed position. A release lever is internally mounted to the body within an interior cavity of the body. The release lever is manually rotatable about a first rotation axis between a disengaged position and an engaged position. When disposed in the disengaged position, the release lever is fully disposed within the interior cavity of the body. When disposed in the engaged position, an arm portion of the release lever traverses across the gap into engagement with the latch mechanism to move the latch mechanism into the unlocked position.

Accordingly, the release lever moves across the gap, which extends laterally or transverse relative to the longitudinal axis of the body, between the door and the body. The release lever is coupled to a cable that is routed to a keyed access location of the vehicle, such as a trunk, cargo area, etc. By pulling the cable in a first direction, the release lever is rotated, such that the arm portion of the release lever traverses the gap and extends into the interior cavity of the door to actuate the electrically actuated latch mechanism into the unlocked position. The release lever, which is manually operated by the cable via the keyed access location of the vehicle, operates the latch mechanism in case electrical power is lost, thereby allowing access into the passenger compartment of the vehicle.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the invention, as defined by the appended claims.

Figures 1, 4:
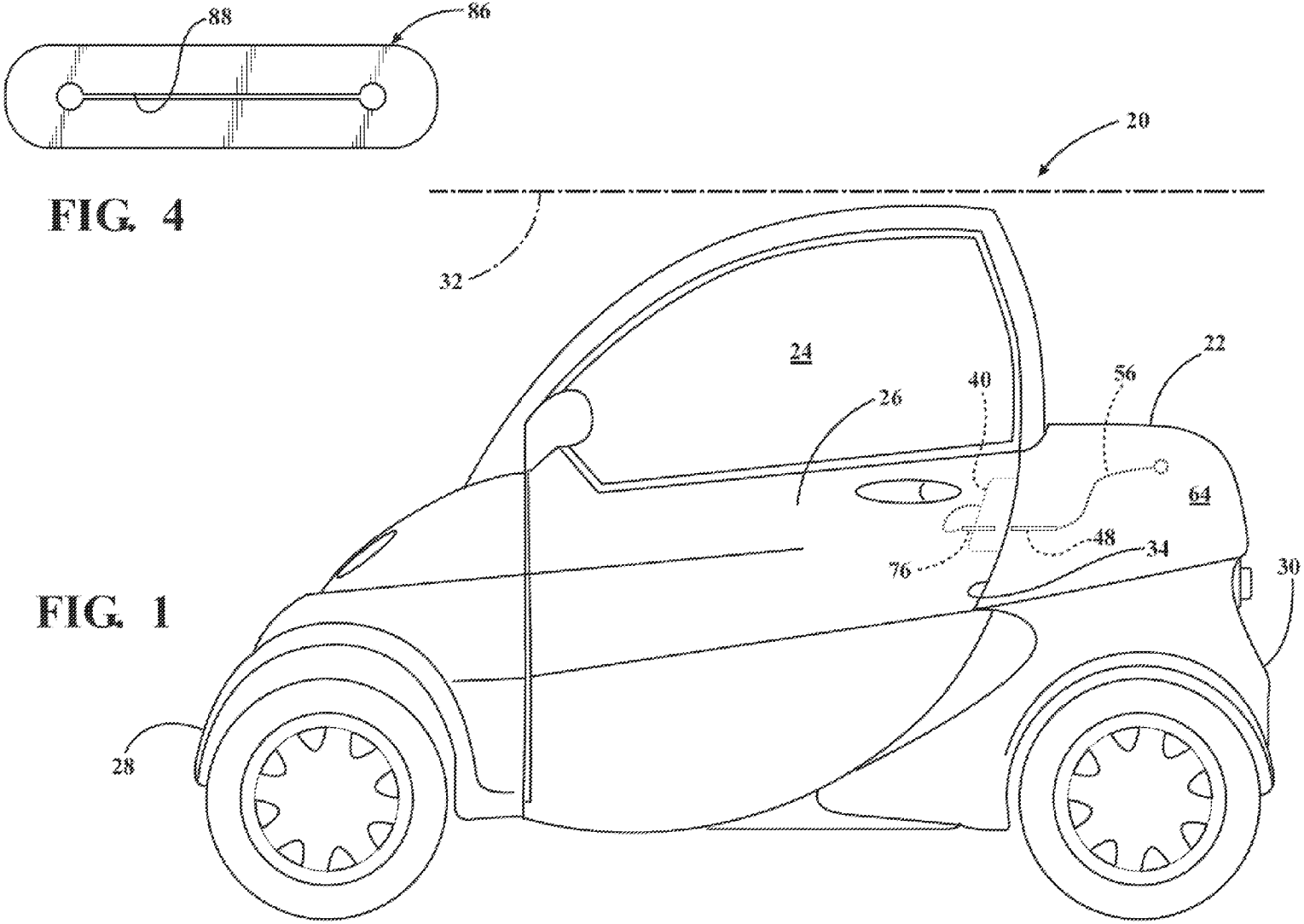
FIG. 1 is a schematic side view of a vehicle.
FIG. 4 is a schematic plan view of a plug.

Referring to the Figures, wherein like numerals indicate like parts throughout the several views, a vehicle is generally shown at 20. Referring to FIG. 1, the vehicle 20 may include any type and/or style of vehicle 20 having a body 22 that defines an enclosed passenger compartment 24 that is accessible through a door 26. For example, the vehicle 20 may include, but is not limited to, a sedan, a sport utility vehicle 20, or a van. Furthermore, the vehicle 20 may include, but is not limited to, a fully electric vehicle 20, a hybrid electric vehicle 20, or a vehicle 20 powered by a conventional internal combustion engine.

The body 22 includes a forward end 28 and a rearward end 30. The forward end 28 is spaced from the rearward end 30 along a longitudinal axis 32 that extends between the forward end 28 and the rearward end 30. The body 22 defines a door opening 34 disposed on a side of the body 22. The door opening 34 is laterally offset from the longitudinal axis 32. The door opening 34 may be disposed on either a driver side of the vehicle 20 or a passenger side of the vehicle 20. While the description describes only a single door opening 34 located on one side of the vehicle 20, it should be appreciated that the vehicle 20 may include two or more door openings 34, located on both sides of the vehicle 20.

The door 26 is pivotably attached to the body 22, and is disposed within the door opening 34. The door 26 is pivotably moveable between an open position and a closed position. When disposed in the open position, the door 26 allows access to the interior or passenger compartment 24 of the vehicle 20. When disposed in the closed position, the door 26 seals the door opening 34 to enclose the passenger compartment 24 of the vehicle 20.

Figure 2:
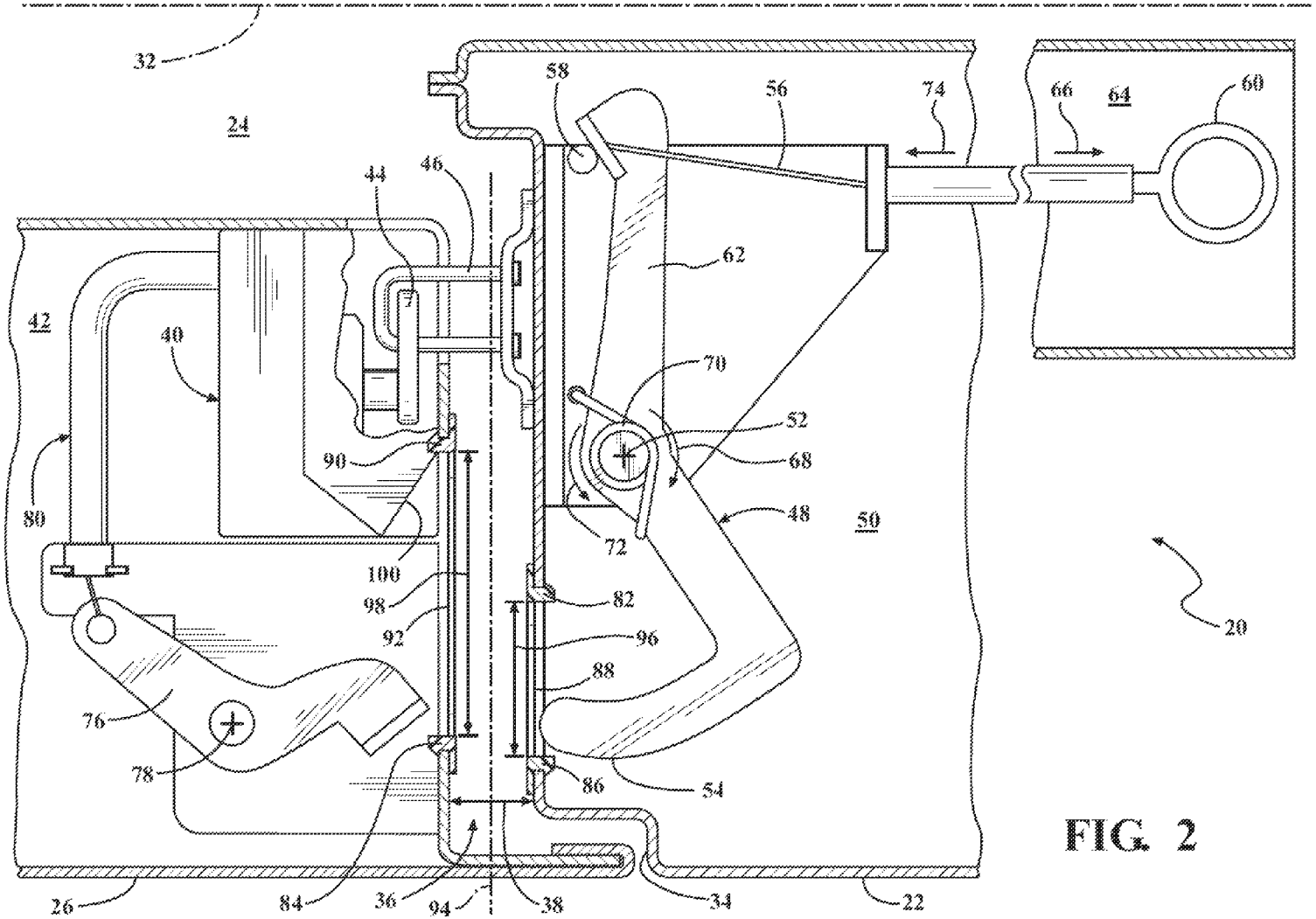
FIG. 2 is a schematic fragmentary cross sectional top view of the vehicle showing a release lever in a disengaged position, a latch lever in an un-actuated position, and a latch mechanism in a locked position.
Figure 3:
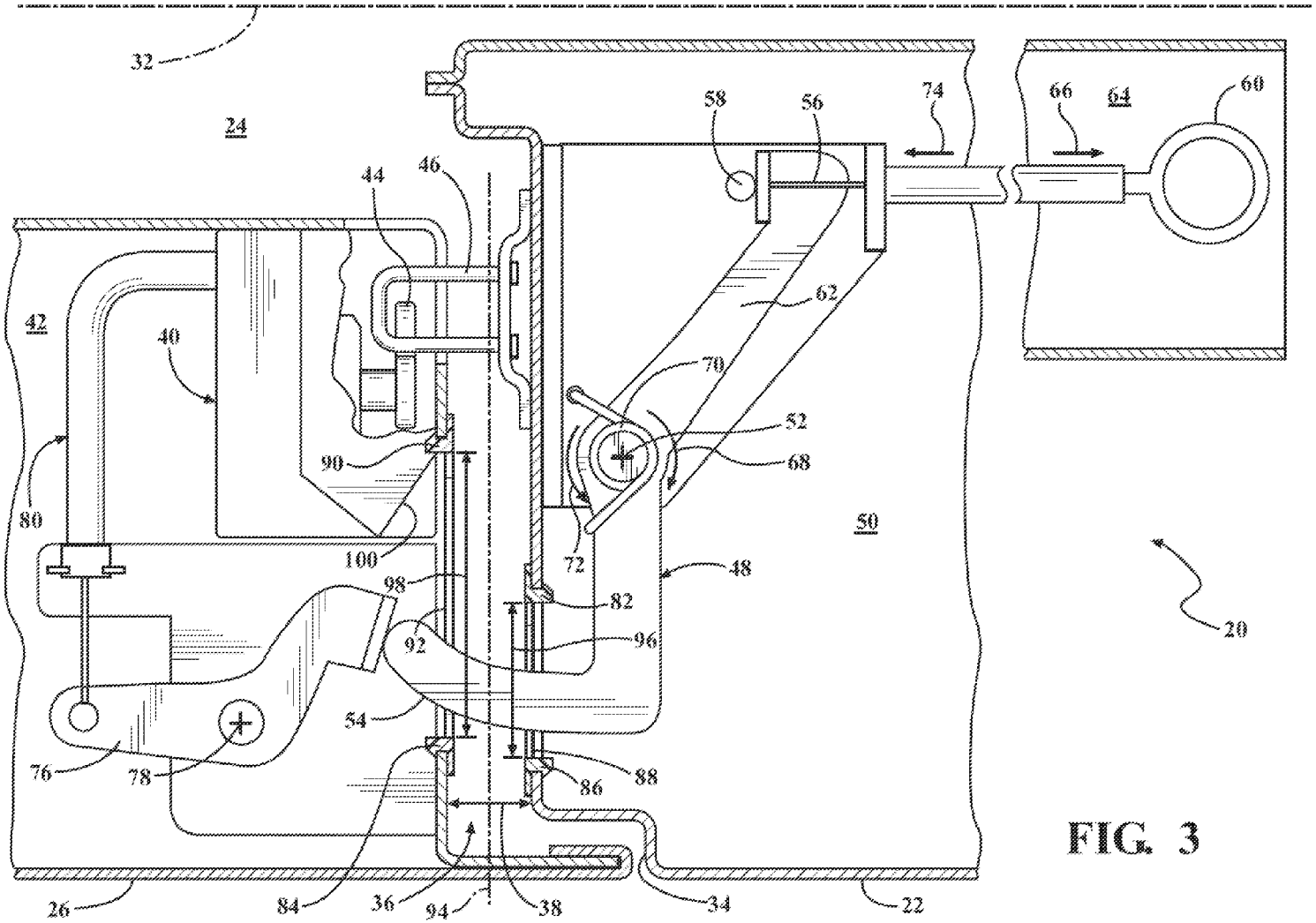
FIG. 3 is a schematic fragmentary cross sectional top view of the vehicle showing the release lever in an engaged position, the latch lever in an actuated position, and the latch mechanism in an unlocked position.

Referring to FIGS. 2 and 3, the door 26 and the body 22 cooperate to define a gap 36 therebetween. The gap 36 extends laterally or transversely relative to the longitudinal axis 32, and vertically between a lower edge of the door 26 and an upper edge of the door 26. The gap 36 may include a distance 38 measured perpendicularly between the door 26 and the body 22, and generally parallel with the longitudinal axis 32, that is between the range of 8 mm and 18 mm, with a manufacturing tolerance of between +/− 1.5 mm. However, it should be appreciated that the gap 36 may define a distance 38 that is outside the above described range.

A latch mechanism 40 is internally mounted to the door 26, within an interior cavity 42 of the door 26. The latch mechanism 40 is moveable between an unlocked position, shown in FIG. 3, and a locked position, shown in FIG. 2. When disposed in the unlocked position, the latch mechanism 40 allows movement of the door 26 between the open position and the closed position. When disposed in the locked position, the latch mechanism 40 is operable to secure the door 26 relative to the body 22 in the closed position. The latch mechanism 40 may include any style and/or configuration of latch suitable for use in the vehicle 20. Typically, the latch mechanism 40 will include a fork bolt 44 that is moveable to engage a striker 46, which is mounted to the body 22, in interlocking engagement when disposed in the locked position. However, it should be appreciated that the scope of the claims should not be limited to the specific configuration and/or operation of the latch mechanism 40. The latch mechanism 40 is moveable between the locked position and the unlocked position in response to an electric signal. Accordingly, the latch mechanism 40 may be described as an electrically actuated latch mechanism 40.

In order to actuate the latch mechanism 40 in the absence of an electrical signal, such as when the vehicle 20 loses electrical power, the vehicle 20 includes a manually actuated back-up latch release system. The manually actuated back-up latch release system includes a release lever 48 that is internally mounted to the body 22, within an interior cavity 50 of the body 22. The release lever 48 is mounted adjacent the door opening 34, such as in a pillar disposed adjacent the door opening 34. The release lever 48 is manually rotatable about a first rotation axis 52 between a disengaged position, shown in FIG. 2, and an engaged position, shown in FIG. 3. When disposed in the disengaged position, the release lever 48 is fully disposed within the interior cavity 50 of the body 22. When disposed in the engaged position, an arm portion 54 of the release lever 48 traverses across the gap 36 into engagement with the latch mechanism 40 to move the latch mechanism 40 into the unlocked position.

The release lever 48 is manually actuated by pulling on a cable 56. The cable 56 includes a first end 58 and a second end 60. The first end 58 of the cable 56 is attached to an actuation arm 62 of the release lever 48. The second end 60 of the cable 56 is disposed in a keyed access compartment 64 defined by the body 22. The keyed access compartment 64 of the body 22 may include a trunk, or a cargo area accessed via a liftgate. The keyed access compartment 64 is an enclosed compartment that is accessed via a mechanical keyed lock. Accordingly, no electrical signal is required to access the keyed access compartment 64. Movement of the cable 56 in a first direction 66 rotates the release lever 48 about the first rotation axis 52 in a first rotational direction 68 to move the release lever 48 from the disengaged position into the engaged position.

The vehicle 20 may include a return spring 70 that interconnects the body 22 and the release lever 48. The return spring 70 biases the release lever 48 about the first rotation axis 52 in a second rotational direction 72. The second rotational direction 72 is opposite the first rotational direction 68. The return spring 70 biases the release lever 48 in the second rotational direction 72 to move the release lever 48 from the engaged position into the disengaged position. As the return spring 70 biases the release lever 48 back into the disengaged position, the release lever 48 pulls the cable 56 in a second direction 74, opposite the first direction 66, to reset the cable 56 for the next use.

As noted above, when the release lever 48 is actuated by pulling the cable 56 in the first direction 66, the arm portion 54 of the release lever 48 traverses across the gap 36 into engagement with the latch mechanism 40 to move the latch mechanism 40 into the unlocked position. More specifically, the arm portion 54 moves from the interior cavity 50 of the body 22, across the gap 36, and into the interior cavity 42 of the door 26 when moving from the disengaged position into the engaged position. In contrast, upon the return spring 70 resetting the release lever 48 and moving the release lever 48 from the engaged position into the disengaged position, the arm portion 54 moves from the interior cavity 42 of the door 26, across the gap 36, and into the interior cavity 50 of the body 22.

A latch lever 76 is coupled to the latch mechanism 40, and is internally mounted to the door 26 within the interior cavity 42 of the door 26. The latch lever 76 is rotatable about a second rotation axis 78 between an un-actuated position, shown in FIG. 2, and an actuated position, shown in FIG. 3. When the latch mechanism 40 is disposed in the locked position, the latch lever 76 is disposed in the un-actuated position. When moved into the actuated position, the latch lever 76 moves the latch mechanism 40 into the unlocked position. The release lever 48 engages and moves the latch lever 76 into the actuated position as the release lever 48 moves into the engagement position to move the latch mechanism 40 into the unlocked position.

As shown in FIGS. 2 and 3, a connecting link 80 interconnects the latch lever 76 and the latch mechanism 40, thereby allowing the latch lever 76 to be remotely located relative to the latch mechanism 40. However, it should be appreciated that the latch lever 76 may be directly attached to the latch mechanism 40, thereby eliminating the connecting link 80 therebetween.

In order to allow the arm portion 54 of the release lever 48 to move between the interior cavity 50 of the body 22 and the interior cavity 42 of the door 26, the body 22 defines a body aperture 82 and the door 26 defines a door aperture 84. The body aperture 82 is open to and allows movement between the gap 36 and the interior cavity 50 of the body 22. The door aperture 84 is open to and allows movement between the gap 36 and the interior cavity 42 of the door 26. The body aperture 82 and the door aperture 84 are aligned with and disposed opposite each other. The arm portion 54 of the release lever 48 passes through the body aperture 82 and the door aperture 84 when moving between the engaged position and the disengaged position.

A body plug 86 is disposed within the body aperture 82. The body plug 86 is operable to seal the body aperture 82, to limit dirt, water and debris from entering the interior cavity 50 of the body 22 through the body aperture 82. Referring to FIG. 4, the body plug 86 includes a first slit 88 to allow the arm portion 54 of the release lever 48 to pass therethrough. A door plug 90 is disposed within the door aperture 84. The door plug 90 is operable to seal the door aperture 84, to limit dirt, water and debris from entering the interior cavity 42 of the door 26 through the door aperture 84. The door plug 90 includes a second slit 92, similar to the first slit 88 shown in FIG. 4, for allowing the arm portion 54 of the release lever 48 to pass therethrough. The door plug 90 and the body plug 86 are preferably manufactured from a resilient, flexible material, such as rubber or some other similar material.

Referring back to FIGS. 2 and 3, the body aperture 82 extends along a transverse axis 94 a first distance 96. The transverse axis 94 is disposed transverse relative to the longitudinal axis 32. The door aperture 84 extends along the transverse axis 94 a second distance 98. The second distance 98 is greater than the first distance 96 to allow the door 26 to move slightly from the closed position toward the open position while the arm portion 54 of the release lever 48 is disposed within the interior cavity 42 of the door 26. In order to facilitate the release lever 48 moving from the engaged position into the disengaged position, the door 26 may define a guide ramp 100. The guide ramp 100 is operable to engage the arm portion 54 of the release lever 48 as the door 26 moves from the closed position into the open position, and rotate the arm portion 54 about the first rotation axis 52 into the disengaged position. The guide ramp 100 ensures that the arm portion 54 of the release lever 48 is at least guided out of the interior cavity 42 of the door 26 and out of interference with the movement of the door 26 between the closed position and the open position. The guide ramp 100 may be defined by any portion of the door 26, including but not limited to the latch mechanism 40. The guide ramp 100 may define a straight linear surface, such as shown in FIGS. 2 and 3, upon which the arm portion 54 of the release lever 48 engages, or may alternatively define a curved surface.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A vehicle comprising:

a body having a forward end and a rearward end spaced from the forward end along a longitudinal axis, and defining a door opening disposed on a side of the body, laterally offset from the longitudinal axis;

a door attached to the body and disposed within the door opening, wherein the door is pivotably moveable between an open position allowing access to an interior compartment of the body, and a closed position sealing the door opening;

wherein the door and the body cooperate to define a gap therebetween extending laterally relative to the longitudinal axis;

a latch mechanism internally mounted to the door within an interior cavity of the door, wherein the latch mechanism is moveable in response to an electronic signal between an unlocked position allowing movement of the door between the open position and the closed position, and a locked position for securing the door relative to the body in the closed position; and a release lever internally mounted to the body within an interior cavity of the body, wherein the release lever is manually rotatable about a first rotation axis between a disengaged position in which the release lever is fully disposed within the interior cavity of the body, and an engaged position in which an arm portion of the release lever traverses across the gap into engagement with the latch mechanism to move the latch mechanism into the unlocked position;

wherein the door defines a guide ramp operable to engage the arm portion of the release lever as the door moves from the closed position into the open position to rotate the arm portion about the first rotation axis into the disengaged position.

2. A vehicle as set forth in claim 1 wherein the arm portion moves from the interior cavity of the body, across the gap, and into the interior cavity of the door when moving from the disengaged position into the engaged position, and wherein the arm portion moves from the interior cavity of the door, across the gap, and into the interior cavity of the body when moving from the engaged position into the disengaged position.

3. A vehicle as set forth in claim 1 further comprising a cable having a first end attached to an actuation arm of the release lever, and a second end disposed in a keyed access compartment of the body, wherein movement of the cable in a first direction rotates the release lever in a first rotation direction to move the release lever from the disengaged position into the engaged position.

4. A vehicle as set forth in claim 1 further comprising a return spring interconnecting the body and the release lever and biasing the release lever in a second rotational direction, opposite the first rotational direction, to move the release lever from the engaged position into the disengaged position.

5. A vehicle as set forth in claim 1 further comprising a latch lever coupled to the latch mechanism and internally mounted to the door within the interior cavity of the door, wherein the latch lever is rotatable between an un-actuated position and an actuated position in which the latch lever moves the latch mechanism into the unlocked position, and wherein the release lever engages and moves the latch lever into the actuated position as the release lever moves into the engagement position to move the latch mechanism into the unlocked position.

6. A vehicle as set forth in claim 5 further comprising a connecting link interconnecting the latch lever and the latch mechanism, wherein the latch lever is remotely located relative to the latch mechanism.

7. A vehicle as set forth in claim 1 wherein the body defines a body aperture open to the gap and the interior cavity of the body, wherein the door defines a door aperture open to the gap and the interior cavity of the door, and wherein the body aperture and the door aperture are aligned with and disposed opposite each other.

8. A vehicle as set forth in claim 7 wherein the arm portion passes through the body aperture and the door aperture when moving between the engaged position and the disengaged position.

9. A vehicle as set forth in claim 7 wherein the body aperture extends along a transverse axis disposed transverse relative to the longitudinal axis a first distance, and the door aperture extends along the transverse axis a second distance, wherein the second distance is greater than the first distance.

10. A vehicle as set forth in claim 7 further comprising a body plug disposed within the body aperture and operable to seal the body aperture, wherein the body plug includes a first slit for allowing the arm portion of the release lever to pass therethrough.

11. A vehicle as set forth in claim 7 further comprising a door plug disposed within the door aperture and operable to seal the door aperture, wherein the door plug includes a second slit for allowing the arm portion of the release lever to pass therethrough.

12. An electric vehicle comprising:

a body having a forward end and a rearward end spaced from the forward end along a longitudinal axis, and defining a door opening disposed on a side of the body;

a door attached to the body and disposed within the door opening, wherein the door is pivotably moveable between an open position allowing access to an interior compartment of the vehicle, and a closed position sealing the door opening;

wherein the door and the body cooperate to define a gap therebetween extending laterally relative to the longitudinal axis;

a latch mechanism internally mounted to the door within an interior cavity of the door, wherein the latch mechanism is moveable in response to an electrical signal between an unlocked position allowing movement of the door between the open position and the closed position, and a locked position for securing the door relative to the body in the closed position;

a release lever internally mounted to the body within an interior cavity of the body, wherein the release lever is rotatable about a first rotation axis between a disengaged position in which the release lever is fully disposed within the interior cavity of the body, and an engaged position in which an arm portion of the release lever traverses across the gap into the interior cavity of the door;

wherein the door defines a guide ramp operable to engage the arm portion of the release lever as the door moves from the closed position into the open position to rotate the arm portion about the first rotation axis into the disengaged position;

a latch lever coupled to the latch mechanism and internally mounted to the door within the interior cavity of the door, wherein the release lever engages and moves the latch lever as the release lever moves into the engagement position to rotate the latch mechanism into the unlocked position;

a cable having a first end attached to an actuation arm of the release lever, and a second end disposed in a keyed access compartment of the body, wherein movement of the cable in a first direction rotates the release lever about the first axis of rotation in a first rotational direction to move the release lever from the disengaged position into the engaged position; and a return spring interconnecting the body and the release lever and biasing the release lever in a second rotational direction, opposite the first rotational direction, to move the release lever from the engaged position into the disengaged position.

13. An electric vehicle as set forth in claim 12 wherein the arm portion moves from the interior cavity of the body, across the gap, and into the interior cavity of the door when moving from the disengaged position into the engaged position, and wherein the arm portion moves from the interior cavity of the door, across the gap, and into the interior cavity of the body when moving from the engaged position into the disengaged position.

14. An electric vehicle as set forth in claim 12 wherein the body defines a body aperture open to the gap and the interior cavity of the body, the door defines a door aperture open to the gap and the interior cavity of the door, and wherein the body aperture and the door aperture are aligned with and disposed opposite each other.

15. An electric vehicle as set forth in claim 14 further comprising a body plug disposed within the body aperture and operable to seal the body aperture, wherein the body plug includes a first slit for allowing the arm portion of the release lever to pass therethrough.

16. An electric vehicle as set forth in claim 14 further comprising a door plug disposed within the door aperture and operable to seal the door aperture, wherein the door plug includes a second slit for allowing the arm portion of the release lever to pass therethrough.

* * * * *